US005611491A

United States Patent [19]

Bowers

[11] Patent Number: 5,611,491

[45] Date of Patent: Mar. 18, 1997

[54] MODULAR $CO_2$ JET SPRAY DEVICE

[75] Inventor: Charles W. Bowers, Torrance, Calif.

[73] Assignee: Hughes Aircraft Company, Los Angeles, Calif.

[21] Appl. No.: 395,124

[22] Filed: Feb. 27, 1995

[51] Int. Cl.[6] ..... B05B 1/30

[52] U.S. Cl. ..... 239/582.1; 239/71; 239/575; 62/603; 134/7

[58] Field of Search ..... 239/575, 581.2, 239/582.1, 71; 62/10; 134/7

[56] References Cited

U.S. PATENT DOCUMENTS

| | | | |
|---|---|---|---|
| 1,200,425 | 10/1916 | Kermode | 239/582.1 |
| 2,583,659 | 1/1952 | Martin | 239/582.1 X |
| 2,600,040 | 6/1952 | Widmayer | 239/581.2 X |
| 3,515,354 | 6/1970 | Presson | 239/582.1 X |

FOREIGN PATENT DOCUMENTS

| | | |
|---|---|---|
| 0288263 | 10/1988 | European Pat. Off. . |
| 0590495 | 4/1994 | European Pat. Off. . |

*Primary Examiner*—Lee W. Young
*Attorney, Agent, or Firm*—M. E. Lachman; M. W. Sales; W. K. Denson-Low

[57] ABSTRACT

A modular jet spray device for use in cleaning submicron sized particles and molecular films using $CO_2$ spray. The modular jet spray device comprises a valve body having first and second ends and an gas input for receiving a $CO_2$ cleaning agent. A jet spray nozzle is removably secured to the first end of the valve body and comprises an input orifice and an output orifice. A sleeve assembly is removably secured to the second end of the valve body, and a needle assembly is removably secured to the sleeve assembly. The needle assembly has a needle that inserts into the input orifice of the nozzle. A micrometer is removably secured-to the sleeve assembly distal from the valve body and is coupled to the needle assembly for adjusting the position of the needle relative to the inlet orifice of the jet spray nozzle. A $CO_2$ gas source is coupled to the gas input of the valve body. Optionally, a filter may be coupled between the $CO_2$ gas source and the gas input of the valve body. The modular jet spray device has a one piece nozzle and orifice that eliminates gaps that cause spitting, clogging, or ice crystal formation. The modular jet spray device provides for a much finer adjustment of spray parameters and is assembled from simple components in modular form. The modular design provides for a rapid matching of output orifice, nozzle, and needle combinations for optimized cleaning of submicron sized particles and molecular films.

5 Claims, 2 Drawing Sheets

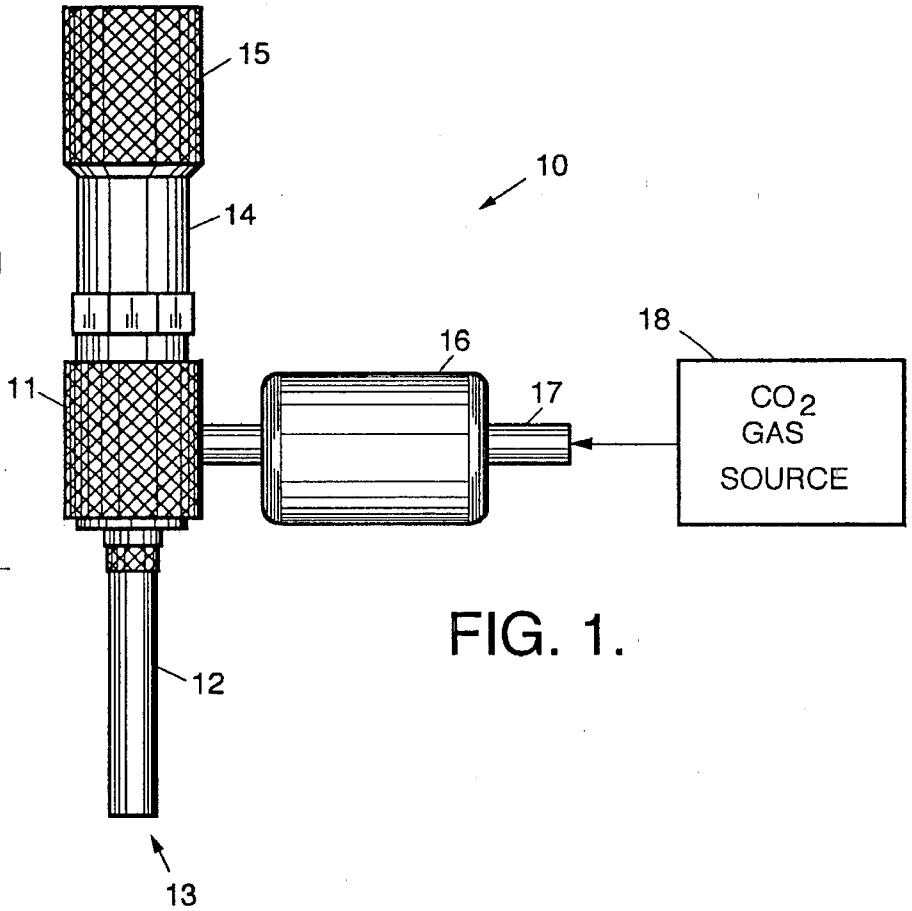
FIG. 1.
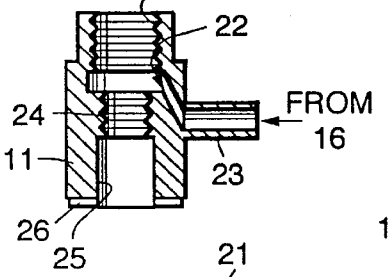
FIG. 2.
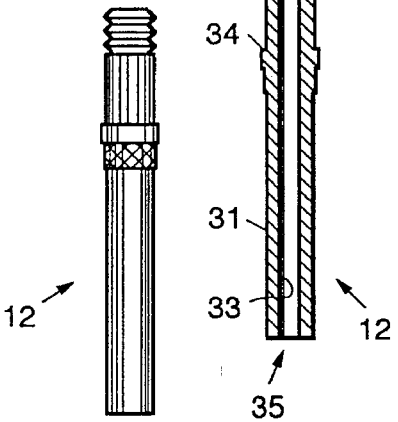
FIG. 3b.
FIG. 3a.
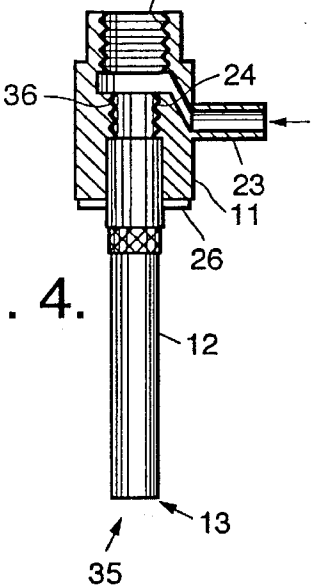
FIG. 4.

MODULAR $CO_2$ JET SPRAY DEVICE

BACKGROUND

The present invention was developed under Contract No. N00030-93-C-0002 awarded by the Department of the Navy. The U.S. government has certain rights in this invention.

The present invention relates to jet spray devices, and more particularly, to a modular jet spray device that provides for optimized cleaning of submicron sized particles and molecular films using environmentally safe $CO_2$ spray.

Heretofore, Freon has been widely used as a cleaning agent to remove submicron sized particles and molecular films from manufactured devices. However, it has been determined that Freon adversely affects the atmosphere, and consequently, Freon is being eliminated as a cleaning agent in manufacturing processes. Carbon dioxide ($CO_2$) spray is now used as a replacement for Freon.

Conventional jet spray devices, such as a jet spray gun manufactured by Vatran located in San Diego, Calif., for example, are relatively imprecise devices and cannot be readily used in areas where very precise and gentle surface cleaning are required. The design is also relatively complex and its manufacture is relatively complicated. Cleaning submicron sized particles and molecular films, such as is required in cleaning traveling wave tubes and silicon wafers, is not possible using the T-2 jet spray gun.

Therefore, it is an objective of the present invention to provide for an improved modular jet spray device that permits cleaning of submicron sized particles and molecular films using $CO_2$ spray.

SUMMARY OF THE INVENTION

In order to meet the above and other objectives, the present invention is a modular jet spray device for use in cleaning submicron sized particles and molecular films using environmentally safe $CO_2$ spray. The modular jet spray device comprises a valve body having first and second ends and a gas input for receiving a $CO_2$ cleaning agent. A jet spray nozzle is removably secured to the first end of the valve body that comprises an input orifice and an output orifice. A sleeve assembly is removably secured to the second end of the valve body, and a needle assembly is removably secured to the sleeve assembly. The needle assembly has a needle that inserts into the input orifice of the nozzle. A micrometer is removably secured to the sleeve assembly distal from the valve body and is coupled to the needle assembly for adjusting the position of the needle relative to the inlet orifice of the jet spray nozzle. A $CO_2$ gas source is coupled to the gas input of the valve body. Optionally, a filter may be coupled between the $CO_2$ gas source and the gas input of the valve body.

The modular jet spray device has a one piece nozzle and orifice that eliminates gaps that cause spitting, clogging, or ice crystal formation. The modular jet spray device provides for a much finer adjustment of spray parameters and is assembled from much simpler designed components in modular form. No other jet spray device has the configuration options offered by this modular design. The modular jet spray device incorporates an innovative needle shaft seal and an integrated nozzle and orifice assembly. The modular design provides for a rapid matching of orifice, nozzle, and needle combinations for optimized cleaning of submicron sized particles and molecular films.

The modular jet spray device is particularly well-suited for cleaning traveling wave tubes, and the like, which have relatively small areas that require delicate cleaning. The modular jet spray device may be used for cleaning solder and brazing residue from electronics packages both before and during assembly processes.

The modular jet spray device is designed to precisely clean very small particles and molecular films from all shapes of surfaces, cylinders, threaded holes, blind holes, helical devices, bearings, cutting tools, ceramic packaging, electronic devices, and precision components. The easily interchangeable nozzles and needle assemblies allow the most rapid optimizing of spray parameters for optimum cleaning of any part or material. The positive needle shaft seal prevents contamination of the spray by particles, or lubricants, from the screw threads.

The modular jet spray device has been used to remove solder flux, solder balls, and molecular films from ceramic electronic packages. It has been used to remove, with very high efficiency, submicron particles from optical surfaces on satellites and telescopes, traveling wave tube microwave devices, computer hard drive discs, semiconductor plastic packages, and optical components. The modular jet spray device has also been used very successfully to remove molecular film from optical surfaces, traveling wave tubes, ceramic surfaces, and metal surfaces.

The modular jet spray device may be used as a replacement for Freon-based power spray devices. The modular jet spray device may also be used in cleaning precision bearings, cryocooler manufacture, large solar collectors, coating processes, high power electrical devices, microelectronics, circuit board assembly, automotive painting surface preparation, and anywhere that solvents are currently being used to remove particulates and organics.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which:

FIG. 1 illustrates a fully assembled modular jet spray device in accordance with the principles of the present invention;

FIG. 2 shows a cross sectional view of the valve body of the modular jet spray device;

FIG. 3 shows a cross sectional view of the jet spray nozzle of the modular jet spray device;

FIG. 4 shows a partial cross sectional view of the assembled body and nozzle of : the modular jet spray device;

DETAILED DESCRIPTION

Figure 7:
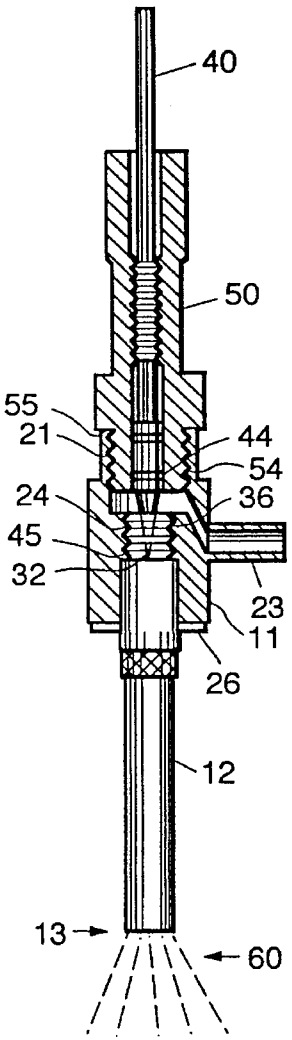
FIG. 7 shows a cross sectional internal view of a fully assembled modular jet spray device.

Referring to the drawing figures, FIG. 1 illustrates a fully assembled modular jet spray device 10 in accordance with the principles of the present invention. The modular jet spray device 10 is comprised of a valve body 11, and a one piece integrated jet spray nozzle 12 and orifice 13 that is secured to the valve body 11. The one piece integrated nozzle 12 and orifice 13 eliminate any possible formation of gaps in the nozzle (found in conventional jet spray devices) that cause spitting, clogging, or ice crystal formation. A needle and sleeve assembly 14 is secured to the valve body 11 and is coupled to the nozzle 12. A micrometer gage 15 is coupled to the needle and sleeve assembly 14. An optional filter 16 may be coupled between the valve body 11 and a $CO_2$ gas source 18 by means of a $CO_2$ gas connection 17. The details of the modular jet spray device 10 will be described below with reference to FIGS. 2–6.

FIG. 2 shows a cross sectional view of the valve body 11 of the modular jet spray device 10 shown in FIG. 1. The valve body 11 has a generally circular cross section and has an hole having various predetermined diameters extending axially therethrough. The valve body 11 has a relatively large diameter internally threaded coupling 21 adjacent one end to which the needle and sleeve assembly 14 is mated. An orifice 22 is provided through a wall of the valve body 11 that is coupled to a short section of tube 23 that mates with the filter 16. A relatively small diameter internally threaded coupling 24 is provided adjacent the center of the valve body 11 that mates with a threaded coupling 36 (FIG. 3 ) on the jet spray nozzle 12. A hole 25 is provided adjacent the other end of the valve body 11 that is larger in diameter than the threaded coupling 24 (on the order of 0.25 inches) into which the jet spray nozzle 12 slides and is secured when it is threaded into the threaded coupling 24. A compression seal 26 is provided at the end of the valve body 11 that seals the nozzle 12 to the valve body 11.

FIG. 3 shows a cross sectional view of the jet spray nozzle 12 employed in the modular jet spray device 10 shown in FIG. 1. The jet spray nozzle 12 is an elongated tube 31 or barrel 31 having an axial hole 33 or bore 33 disposed therethrough that tapers to form an inlet orifice 32 at one end thereof. The bore 33 may be on the order of 0.167 inches in diameter, for example. The axial hole 33 forms the output orifice 35 at an end thereof opposite the inlet orifice 32. The jet spray nozzle 12 has a threaded coupling 36 disposed adjacent the inlet orifice 32 that mates with the threaded coupling 24 in the valve body 11. The cross section of the jet spray nozzle 12 is stepped along its length in the manner shown in FIG. 3 and has a shoulder 34 that mates with the seal 26 of the valve body 11 when the jet spray nozzle 12 and valve body 11 are assembled.

FIG. 4 shows a partial cross sectional view of the assembled valve body 11 and jet spray nozzle 12 of the modular jet spray device 10 of FIG. 1. The jet spray nozzle 12 is shown threaded into the valve body 11 by means of the two threaded couplings 24, 36. The sealing of the jet spray nozzle 12 and valve body 11 is provide by the seal 26 to which the shoulder 34 of the jet spray nozzle 12 abuts when the modular jet spray device 10 is assembled.

Figure 6:
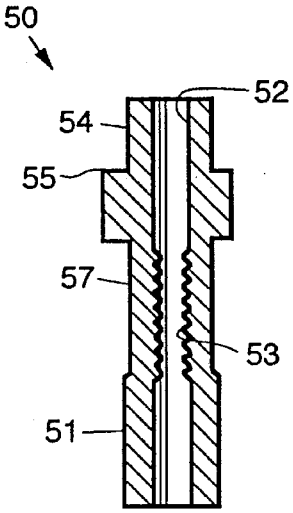
FIG. 6 shows a cross sectional view of the sleeve assembly of the modular jet spray device.
Figure 5:
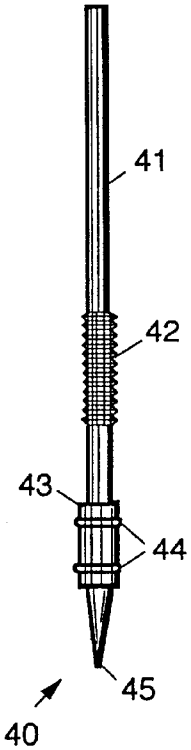
FIG. 5 shows a cross sectional view of the needle assembly of the modular jet spray device.

FIG. 5 shows a cross sectional view of a needle assembly 40 used in the modular jet spray device 10 shown in FIG. 1. The needle assembly 40 is comprised of a relatively small cross section solid body 41 that is pointed at one end to form a needle 45. The body 41 has a threaded coupling 42 generally adjacent its center that is larger than the nominal diameter of the body 41. The threaded coupling 42 is used to mate with an internal threaded coupling 53 (FIG. 6) in the sleeve assembly 50. The body 41 has a sealing section 43 that comprises a relatively large diameter portion of the body 41 that has a plurality of O-rings 44 disposed in grooves formed in the sealing section 43. The O-rings form a needle shaft seal between the needle assembly 40 and the sleeve assembly 50 (FIG. 6). The O-rings 44 are designed to seal the needle assembly 40 when it is mated to the valve body 11. The needle assembly 40 is mated with the sleeve assembly 50, which is illustrated in FIG. 6.

FIG. 6 shows a cross sectional view of the sleeve assembly 50 used in the modular jet spray device 10 shown in FIG. 1. The sleeve assembly 50 mates with and secures the needle assembly 40 and comprises a body 51 having an axial hole 52 therethrough into which the needle assembly 40 is inserted. The sleeve assembly 50 has an internal threaded coupling 53 disposed within the axial hole 52 that mates with the threaded coupling 42 of the needle assembly 40. The sleeve assembly 50 has an outer threaded coupling 54 that mates with the threaded coupling 21 of the valve body 11. A shoulder 55 is provided that limits insertion of the sleeve assembly 50 into the valve body 11. The sleeve assembly 50 also has a second outer threaded coupling 56 to which the micrometer gage 15 is secured.

FIG. 7 shows a cross sectional internal view of a fully assembled modular jet spray device 10. The sleeve assembly 50 is shown threaded into the valve body 11 by means of the threaded couplings 24, 54. The needle 45 is shown extending into the inlet orifice 32 of the jet spray nozzle 12. Changing the relative position of the needle 45 in the inlet orifice 32 changes the amount of carbon dioxide ($CO_2$) spray 60 that emanates from the nozzle 12. The jet spray nozzle 12 is internally sealed by means of the seal 26 and the O-rings 44 where they mate with their corresponding surfaces and the metal to metal seals provided by the threaded couplings 21, 54, 24, 36.

The modular jet spray device 10 provides for a much finer adjustment of spray parameters and is assembled from easily manufacturable components in modular form. No other jet spray device has the configuration options offered by this modular design. The design of the modular jet spray device 10 provides for rapid matching of orifice 35, nozzle 12, and needle assembly 40 combinations for optimized cleaning of submicron sized particles and molecular films.

The modular jet spray device 10 has been built and tested using $CO_2$ spray as a cleaning agent and has successfully removed particulates from substrates with minimal risk. A number of tests were performed along with other non-product evaluations to investigate the performance of the modular jet spray device 10 using $CO_2$ spray as a cleaning agent.

In order to prove out the present invention, a low-temperature cofired ceramic electronics package was evaluated for $CO_2$ spray cleaning. The package had a residue of solder flux and some solder balls left from a furnace brazing process that attaches a hermetic seal ring. The residue proved quite tenacious when an attempt was made to clean the package with solvents and ultrasonic techniques. Using the modular jet spray device 10 the solder flux and solder balls were removed using an aggressive $CO_2$ spray in a clean dry booth (CDB) environment.

The low-temperature cofired ceramic package was sprayed using the modular jet spray device 10 for about 30 seconds per braze joint using a model 882 nozzle (0.150 to 0.1625 inches in diameter) manufactured by the assignee of the present invention. The micrometer setting was 85 on the needle valve and the working distance was ½ inch to ¾ inch from the braze fillet that was to be cleaned at a near normal angle. This produced a very aggressive spray plume that thermally shocked the flux and then cracked and removed it from the braze joint.

With this success, 24 additional low-temperature cofired ceramic packages were processed to remove solder balls and flux therefrom. All low-temperature cofired ceramic packages were cleaned in the same manner as described above. Initial results indicate that an improvement in wire bond strength was seen although a small amount of flux remained on the wire bond pads. This wire bond area was not a primary area of concern of the $CO_2$ cleaning effort and the bond strength improvement was an added bonus that was not expected. A film was removed from most of the wire bond areas, although some of the wire bond areas had a heavy film and some were quite clean. Only the film that was visible was removed since these areas are plasma etched prior to wire bonding in following process steps. Thus, it was determined that the modular jet spray device 10 may be used for cleaning the solder and brazing residue from electronics packages both before and during assembly processes.

The modular jet spray device 10 was also tested with traveling wave tubes manufactured by the assignee of the present invention in order to determine if $CO_2$spray cleaning could replace Freon spray cleaning of the tubes. Four traveling wave tubes were cleaned with $CO_2$ spray using the modular jet spray device 10. The tubes were fabricated into completed assemblies and then evaluated during vacuum bakeout and acceptance tests. The results of these tests indicate that $CO_2$ spray cleaning can be used to replace Freon spray cleaning in the traveling wave tube fabrication process.

A traveling wave tube is constructed by brazing copper clad magnetic iron washers to monel spacers in an alternating fashion. The resulting structure looks much like a string of beads on an abacus. After the stack is brazed in a hydrogen furnace, the interior of the barrel is precision honed and cleaned with an ultrasonic probe to remove the honing debris. The barrel is heated up and internal components installed, producing a slight mechanical press fit upon barrel cooling.

The internal barrel of an assembled traveling wave tube contains a helical coil and 3 boron nitride positioning rods that are coated with pyrolytic carbon. All foreign material must be removed after assembly and prior to vacuum bakeout. These tubes are evacuated and sealed at $10^{-9}$ torr during final assembly and outgassing particles cause failure. Removal of the pyrolytic carbon or repositioning of the interior coils during the cleaning process adversely affect the performance of the traveling wave tube.

All cleaning was done in a clean dry booth (CDB) to prevent condensation and possible damage to the carbon film. Each traveling wave tube was sprayed externally for about 30 seconds to remove any particles and prevent any migration of particles back into the inside of the tube. The interior was sprayed for about 5 minutes total while rotating the tube around the $CO_2$ spray plume. The plume was oriented with about a 10 degree angle to the axis of the tube and at times a 10 degree tilt to produce a spiral cleaning action. A very aggressive nozzle (model 882) was used with the modular jet spray device 10 with a setting of 90 as read by the micrometer gage 15. This produced a very compact but powerful and aggressive spray that did not build up in the barrel 31 of the nozzle assembly 12 and clog it shut. The traveling wave tube was swapped end for end several times during cleaning and warmed up twice during cleaning. A very light film, possibly organic, frosted up on the outside of the traveling wave tube during cleaning, was easily cleaned, and did not reappear during further interior spraying.

The before and after cleaning results appeared very dramatic even though it was not possible to quantify tube cleanliness. The traveling wave tubes were inspected visually by setting the bore at a white wall or a fluorescent light. The bores were all very dirty and dull prior to cleaning and were bright and mirror like after the $CO_2$ spraying using the modular jet spray device 10. No particles were visible in any of the traveling wave tubes after cleaning, although it was impossible to see into the voids that may be left after brazing.

The total time spent cleaning, from unbagging to rebagging of the traveling wave tubes, was about 20 minutes per tube. This time may be reduced using a fixture that holds the traveling wave tube and sites the bore at a bright surface so the cleaning is monitored. For maximum efficiency and optimum results, the fixture should rotate the traveling wave tube about 2 to 5 RPM and hold the nozzle 12 at fixed angle.

The modular jet spray device 10 was used to provide $CO_2$ spray cleaning that removed spacer balls from counter electrodes used in the traveling wave tubes. Particles are a major cause of defective traveling wave tubes, and the use of $CO_2$ spray cleaning with the modular jet spray device 10 is the only cleaning apparatus that allows one-step cleaning after manufacture. The results from cleaning tests showed no effect on the components or their alignment, only areas free of particulates.

Thus there has been described a new and improved modular jet spray device that provides for optimized cleaning of submicron sized particles and molecular films. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A modular jet spray device for producing a spray of carbon dioxide snow for cleaning submicron sized particles and molecular films, said device comprising:

a valve body having first and second ends and a gas input for receiving a $CO_2$ cleaning agent and having a generally circular cross section and a hole extending axially therethrough, and wherein the valve body comprises:

a first_relatively large internally threaded coupling adjacent one end to which the sleeve assembly is secured;

an orifice disposed through a wall of the valve body that provides an inlet for the $CO_2$ cleaning agent;

a second relatively small diameter internally threaded coupling adjacent the center of the valve body that mates with the jet spray nozzle;

a hole adjacent the other end of the valve body that is larger in diameter than the second threaded coupling; and a compression seal disposed at the end of the valve body that seals the nozzle to the valve body;

a jet spray nozzle removably secured to the first end of the valve body and comprising an inlet orifice and an output orifice;

a sleeve assembly removably secured to the second end of the valve body;

a needle assembly removably secured to the sleeve assembly and having a needle that inserts into the inlet orifice of the nozzle;

a micrometer removably secured to the sleeve assembly distal from the valve body and coupled to the needle assembly for adjusting the position of the needle relative to the inlet orifice of the jet spray nozzle; and a $CO_2$ gas source coupled to the gas input of the valve body.

2. The device of claim 1 further comprising a filter coupled between the $CO_2$ gas source and the gas input of the valve body.

3. The device of claim 1 wherein the jet spray nozzle comprises an elongated tube having an axial hole disposed therethrough that tapers to form the inlet orifice at one end thereof, and wherein the axial hole forms the output orifice at an end of the nozzle opposite the inlet orifice, and wherein the jet spray nozzle comprises a threaded coupling disposed adjacent the inlet orifice that mates with the threaded coupling in the valve body.

4. The device of claim 1 wherein the needle assembly comprises:

a relatively small cross section solid body that is pointed at one end to form a needle;

a threaded coupling disposed adjacent its center that is larger than the nominal diameter of the body that is used to mate with an internal threaded coupling in the sleeve assembly;

a sealing section that comprises a relatively large diameter portion of the body that has a plurality of O-rings disposed in grooves formed in the sealing section, which O-rings form a needle shaft seal between the needle assembly and the sleeve assembly.

5. The device of claim 1 wherein the sleeve assembly comprises: a body having an axial hole therethrough into which the needle assembly is inserted;

an internal threaded coupling disposed within the axial hole that mates with a threaded coupling of the needle assembly;

an outer threaded coupling that mates with threaded coupling of the valve body;

a shoulder for limiting insertion of the sleeve assembly into the valve body; and a second outer threaded coupling to which the micrometer is secured.

* * * * *